US006713956B2

(12) United States Patent
Hsing Chen et al.

(10) Patent No.: US 6,713,956 B2
(45) Date of Patent: Mar. 30, 2004

(54) DISPLAY MODULE INCLUDING A PLATE FOR HEAT DISSIPATION AND SHIELDING

(75) Inventors: Chen-Lun Hsing Chen, Taipei Hsien (TW); Po-Hsien Lee, Taipei Hsien (TW); I-Hsiang Li, Taipei Hsien (TW)

(73) Assignee: Lite-On Technology Corporation, Taipei (TW)

( * ) Notice: Subject to any disclaimer, the term of this patent is extended or adjusted under 35 U.S.C. 154(b) by 86 days.

(21) Appl. No.: 09/910,762

(22) Filed: Jul. 24, 2001

(65) Prior Publication Data

US 2003/0020400 A1 Jan. 30, 2003

(51) Int. Cl.[7] ..... H05B 33/00; G09F 13/18
(52) U.S. Cl. ..... 313/512; 313/46; 362/800
(58) Field of Search ..... 313/498–512, 313/46; 362/294, 373, 89, 800, 812, 559, 560

(56) References Cited

U.S. PATENT DOCUMENTS 4,729,076 A * 3/1988 Masami et al. ..... 362/235
5,613,861 A * 3/1997 Smith et al. ..... 439/81
5,797,672 A * 8/1998 Dobert ..... 362/190
5,857,767 A * 1/1999 Hochstein ..... 362/294
6,428,189 B1 * 8/2002 Hochstein ..... 362/373
6,439,731 B1 * 8/2002 Johnson et al. ..... 362/29
6,465,858 B2 * 10/2002 Iida et al. ..... 257/433
6,480,389 B1 * 11/2002 Shie et al. ..... 361/707
6,481,130 B1 * 11/2002 Wu ..... 40/546
6,481,131 B2 * 11/2002 Gianotti et al. ..... 40/546
6,550,953 B1 * 4/2003 Ichikawa et al. ..... 315/56

* cited by examiner

*Primary Examiner*—Nimeshkumar D. Patel
*Assistant Examiner*—Karabi Guharay
(74) *Attorney, Agent, or Firm*—Rabin & Berdo, P.C.

(57) ABSTRACT

A display module comprises a plurality of light emitting elements, a metal plate, a circuit board and a display panel. The light emitting elements and the circuit board are arranged on the metal plate, and the light emitting elements are wire bonded to the circuit board. A lens is formed atop the light emitting element. The metal plate is arranged with the light emitting elements and the circuit board is positioned on lateral side or around the display panel. The metal plate provides excellent heat-dissipation effect and the light emitting elements can emit more uniform light.

19 Claims, 3 Drawing Sheets

DISPLAY MODULE INCLUDING A PLATE FOR HEAT DISSIPATION AND SHIELDING

FIELD OF THE INVENTION

The present invention relates to a display module, especially to a display module with excellent heat-dissipation effect and more uniform light.

BACKGROUND OF THE INVENTION

The light emitting diodes (LED) are extensively used in indication and illumination application. The LEDs are generally made of direct-bandgap material with two electrodes. The electrical power is applied through the electrodes to generate electron and hole pair. The electron and hole pair is recombined to emit light. The LED can be roughly classified to visible light LED and infrared LED according to the emitting wavelength thereof. The LEDs have salient properties over the conventional light bulb such as compact volume, lower power consumption, lower thermal radiation and long life. Therefore, the LEDs are extensively used in indication usage in place of light bulb.

Moreover, as the advent and maturity of high brightness LED, the application of LEDs is broadened to compass bulletin board. The high brightness LEDs have the advantages of broad view angle, stable picture, easy assembling and thin thickness. The full color high brightness LED is realized as the high brightness LEDs of three primitive colors are successfully developed.

FIG. 1 shows the sectional view of prior art LED display panel. The LEDs 11*a* are arranged in 3×3, 4×4, or 4×8 array and assembled to a display module 1*a*. A plurality of display modules 1*a* are assembled to a larger display panel. The LEDs 11*a* are packaged by epoxy resin and soldered to a printed circuit board 12*a*. Afterward, the LEDs 11*a* are arranged within a shade 13*a* formed by mold ejection and are retained by filling resin 14*a*. The shade 13*a* provides a sun blind 131*a* for the LEDs 11*a*.

However, the display module la has not satisfactory heat dissipation effect such that the heat caused by insolation or driving of the LEDs cannot be easily dissipated. The performance of the display module 1*a* is degraded.

SUMMARY OF THE INVENTION

It is the object of the present invention to provide a display module with excellent heat-dissipation effect and more uniform light.

To achieve above object, the present invention provides a display module comprising a plurality of light emitting elements, a metal plate, a circuit board and a display panel. The light emitting elements and the circuit board are arranged on the metal plate, and the light emitting elements are wire bonded to the circuit board. A lens is formed atop the light emitting element. The metal plate is arranged with the light emitting elements and the circuit board is positioned on lateral side or around the display panel. The metal plate provides excellent heat-dissipation effect and the light emitting elements can emit more uniform light.

The various objects and advantages of the present invention will be more readily understood from the following detailed description when read in conjunction with the appended drawing, in which:

DETAILED DESCRIPTION OF THE INVENTION

Figure 1:
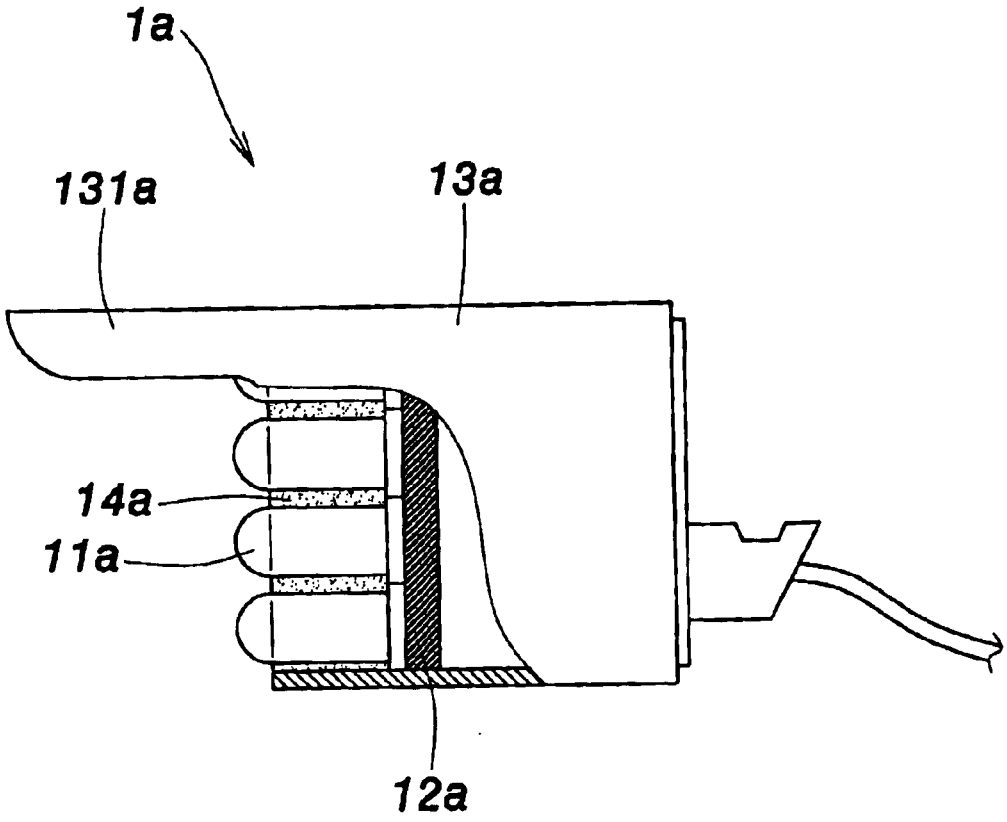
FIG. 1 PRIOR ART
FIG. 1 shows the sectional view of prior art LED display panel.
Figure 2:
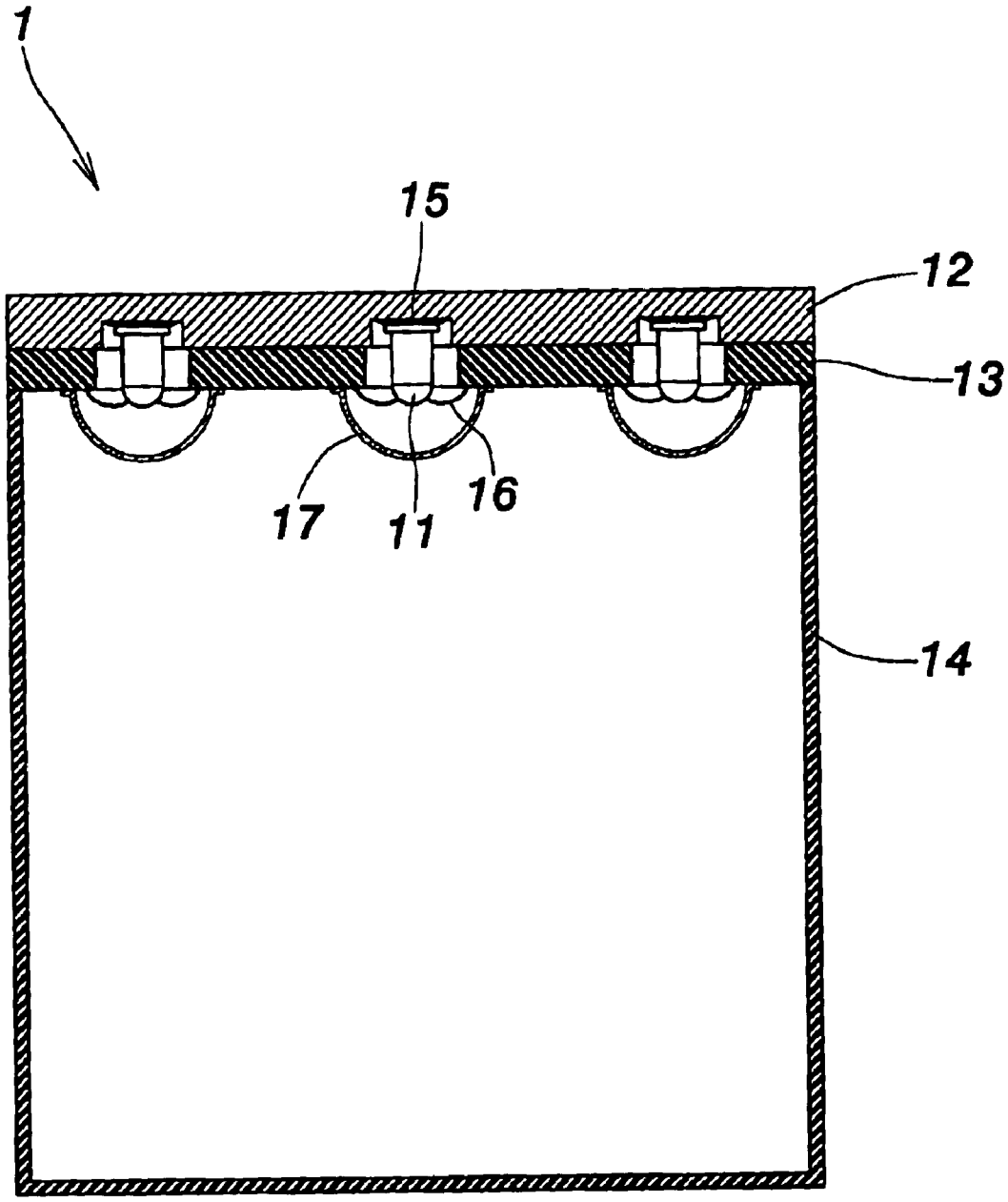
FIG. 2 shows the sectional view of the present invention.
Figure 3:
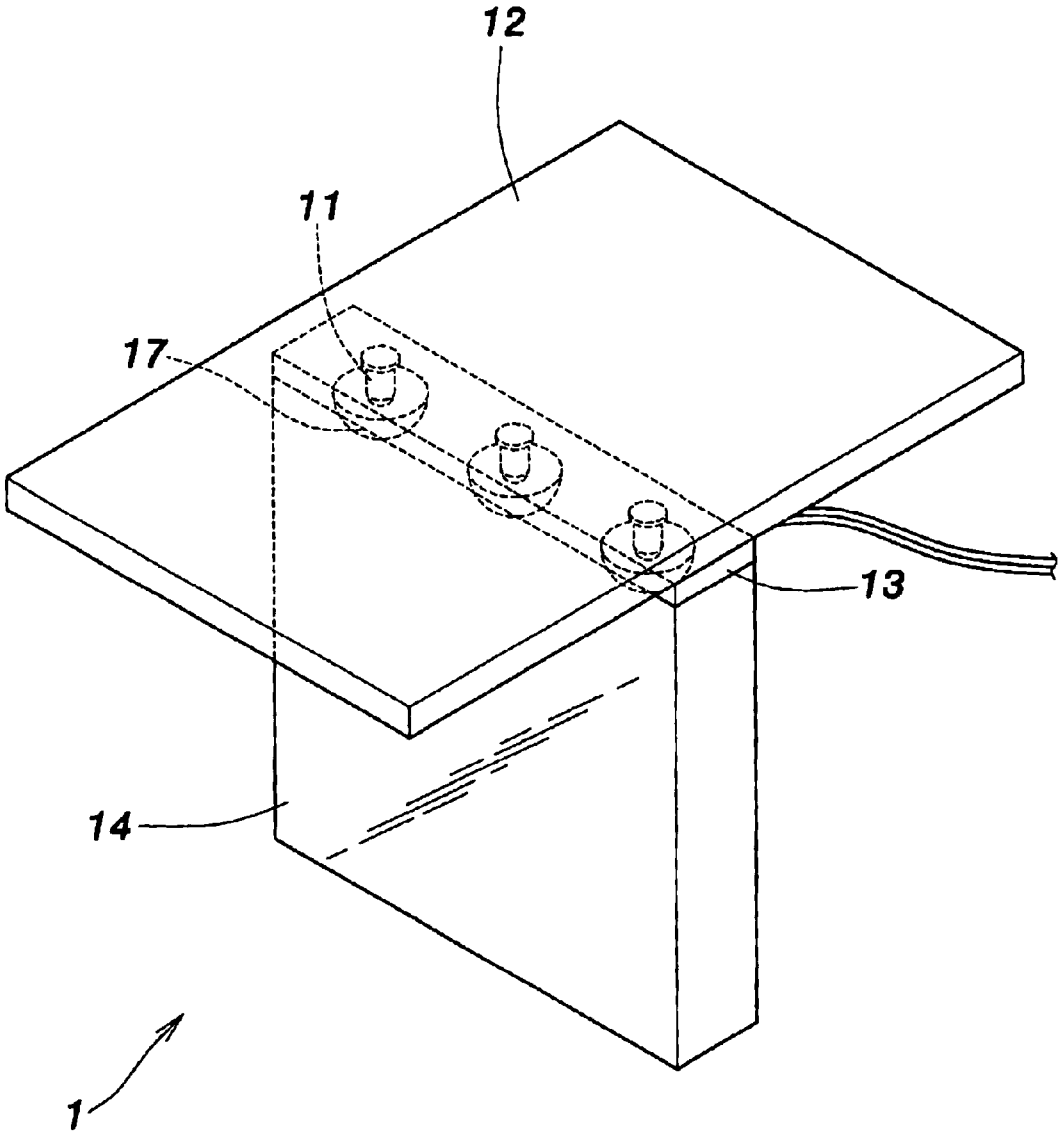
FIG. 3 shows the perspective view of the present invention.

With reference now to FIGS. 2 and 3, the present invention provides a display module 1 composed of a plurality of light emitting elements 11, a metal plate 12, a circuit board 13 and a display panel 14. The light emitting elements 11 are fitted through holes formed in the circuit board and are pasted in a row to the metal plate 12 by insulative thermal glue 15. The light emitting elements 11, for example, can be LEDs and wire bonded to the circuit board 13 by conductive wire 16 such that the LEDs are electrically connected to copper trace on the circuit board. Afterward, the wire bonded LED is encapsulated by epoxy material to form a lens 17 thereon. As shown in FIG. 3, the light emitting elements 11 in a row are arranged on lateral side or around the display panel 14. The display panel 14 can be made of acrylic or polyethylene material and be of rectangular or circular shape. The display panel 14 may be coated with lacquer or adhesive tapes (not shown) may be pasted to the backside and lateral sides thereof. The adhesive tapes are of black or white acrylic material to block light or reflect light. A plurality of display modules 1 are assembled into a larger display panel.

The light from the light emitting elements 11 uniformly impinge into the display panel 14 for display graphic or text on the display panel 14. The metal plate 12 and the display panel 14 form a T-shape with extension portions of the metal plate being used for sunproof function. The metal plate also dissipates the heat of the light emitting elements 11.

Moreover, the light emitting elements 11 can be of same color or different color such that the light emitting elements 11 have better color mixing effect than conventional LEDs. Moreover, the light emitting elements 11 form non-granular light dot, which is suitable for both near- and far-distance display.

In the present invention, the metal plate 12 provides excellent heat-dissipation effect to facilitate the light emitting elements 11 being operated at large current. The light emitting elements 11 can emit more uniform light and the display panel 14 can also uniform the light.

To sum up, the LED display module according to the present invention has following advantages:

(1). The LEDs are directly bound to the metal plate, thus having excellent heat-dissipation effect.

(2). The metal plate also has sunproof function.

(3). The LED display module has satisfactory color-mixing effect.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

We claim:

1. A display module, comprising:

a plurality of light emitting elements;

a metal plate;

a circuit board; and a display panel, wherein the light emitting elements and the circuit board are arranged on the metal plate, and the light emitting elements are wire bonded to the circuit board, and a respective lens is formed atop each respective light emitting element, wherein the metal plate is arranged with the light emitting elements directly adhered thereto, and the circuit board is positioned on a side of the the display panel, and wherein said metal plate is arranged to be perpendicular to said display panel, with said metal plate and said display panel collectively forming a T shape.

2. The display module as in claim 1, wherein each light emitting element is an LED.

3. The display module as in claim 1, wherein the light emitting elements are pasted to the metal plate.

4. The display module as in claim 1, wherein the light emitting elements emit light with same color or different colors.

5. The display module as in claim 1, wherein the display panel has a rectangular shape or circular shape.

6. The display module as in claim 1, wherein the display panel is coated with a lacquer or pasted with light-blocking or light-reflecting tape on a circumference or backside thereof.

7. A display module, comprising:

a rectangular display panel having two primary surfaces and four lateral sides;

a circuit board located in one of the lateral sides;

a plate mounted on the circuit board and having an extension portion to shield at least one of the primary surfaces; and a plurality of light emitting elements mounted on the plate, being arranged at the one lateral side to emit light inside the display panel, and being electrically connected with the circuit board.

8. The display module as in claim 7, wherein the four lateral sides are disposed at an outer periphery of the two primary surfaces, so that the four lateral sides and two primary surfaces form a cuboid.

9. The display module as in claim 8, wherein the circuit board includes a plurality of holes, and the light emitting elements are fitted through the holes, respectively, to be mounted on the plate.

10. The display module as in claim 8, wherein the light emitting elements are wire bonded to the circuit board.

11. The display module as in claim 8, further comprising a plurality of lenses, each being disposed on top of a respective light emitting element to encapsulate each of the light emitting elements.

12. The display module as in claim 7, wherein the plate is metal.

13. The display module as in claim 7, wherein the light emitting elements are light emitting diodes.

14. The display module as in claim 13, wherein the light emitting diodes are of same color.

15. The display module as in claim 13, wherein the light emitting diodes have different colors.

16. The display module as in claim 7, wherein the light emitting elements are adhered to the plate using an insulative thermal glue.

17. The display module as in claim 7, wherein the display panel is coated with a lacquer.

18. The display module as in claim 7, wherein the display panel has one of a light-blocking and a light-reflecting tape adhered thereto.

19. A display module, comprising:

a display panel;

a circuit board attached to said display panel;

a thermally conductive plate having a central portion mounted on said circuit board, and having extension portions that extend past respective primary surfaces of said display panel to provide a sun shield for the primary surfaces, said heat conductive plate and said display panel collectively forming a T-shape; and a plurality of light emitting elements directly bounded to said plate, being arranged to emit light inside said display panel, and being electrically connected with said circuit board.

* * * * *